United States Patent [19]

Kinder et al.

[11] Patent Number: 5,045,881

[45] Date of Patent: Sep. 3, 1991

[54] SYSTEM FOR SEGREGATING PURGE SHEETS AND CONTINUED PRINTING

[75] Inventors: Carla J. Kinder, Ontario; William M. OuYang, Pittsford; Michael E. Farrell, Fairport, all of N.Y.

[73] Assignee: Xerox Corporation, Stamford, Conn.

[21] Appl. No.: 574,877

[22] Filed: Aug. 30, 1990

[51] Int. Cl.[5] ..... G03G 15/00

[52] U.S. Cl. ..... 355/206; 355/314; 355/77; 271/258

[58] Field of Search ..... 355/77, 314, 308, 309, 355/206, 207; 271/258, 256, 265, 288

[56] References Cited

U.S. PATENT DOCUMENTS

| | | | |
|---|---|---|---|
| 3,778,051 | 12/1973 | Allen et al. | 271/57 |
| 3,936,180 | 2/1976 | Willard et al. | 355/14 |
| 4,231,567 | 11/1980 | Ziehm | 271/259 |
| 4,655,582 | 4/1987 | Okuda et al. | 355/206 |
| 4,684,235 | 8/1987 | Kohimoto et al. | 355/206 |
| 4,750,020 | 6/1988 | Ishizu et al. | 355/14 |
| 4,758,860 | 7/1988 | Takayanagi et al. | 355/206 |
| 4,782,363 | 11/1988 | Britt et al. | 355/14 |

*Primary Examiner*—R. L. Moses

[57] ABSTRACT

In copying or printing, proper printed copy sheets generated from the printing operation may be selectably operator directed to various different copy sheet output compiling stations, such as a stacking tray or a finisher compiler. Those copy sheets desired to be purged rather than provided as finished copies {called purge sheets below} are directed to a particlar designated such station for operator removal and disposal. Preferably this designated purge station is a readily operator accessible existing top tray. In this system, reduced printing delays are provided by continuing the printing process as long as the proper copy sheets are selectably directed to a copy sheet output compiling station which is not the same tray or station into which the purge sheets have been directed in the same printing operation, or, as long as the proper copy sheets will not be stacked on top of the purge sheets in that same tray. The printing operation of the copy sheets is automatically stopped to prevent such intermixing of the purged sheets with the proper copy sheets in the same output tray. However, this interrupted printing operation can then resume in response to sensing that all the sheets in that tray have been removed, which may be directed.

6 Claims, 1 Drawing Sheet

SYSTEM FOR SEGREGATING PURGE SHEETS AND CONTINUED PRINTING

Figure 1:
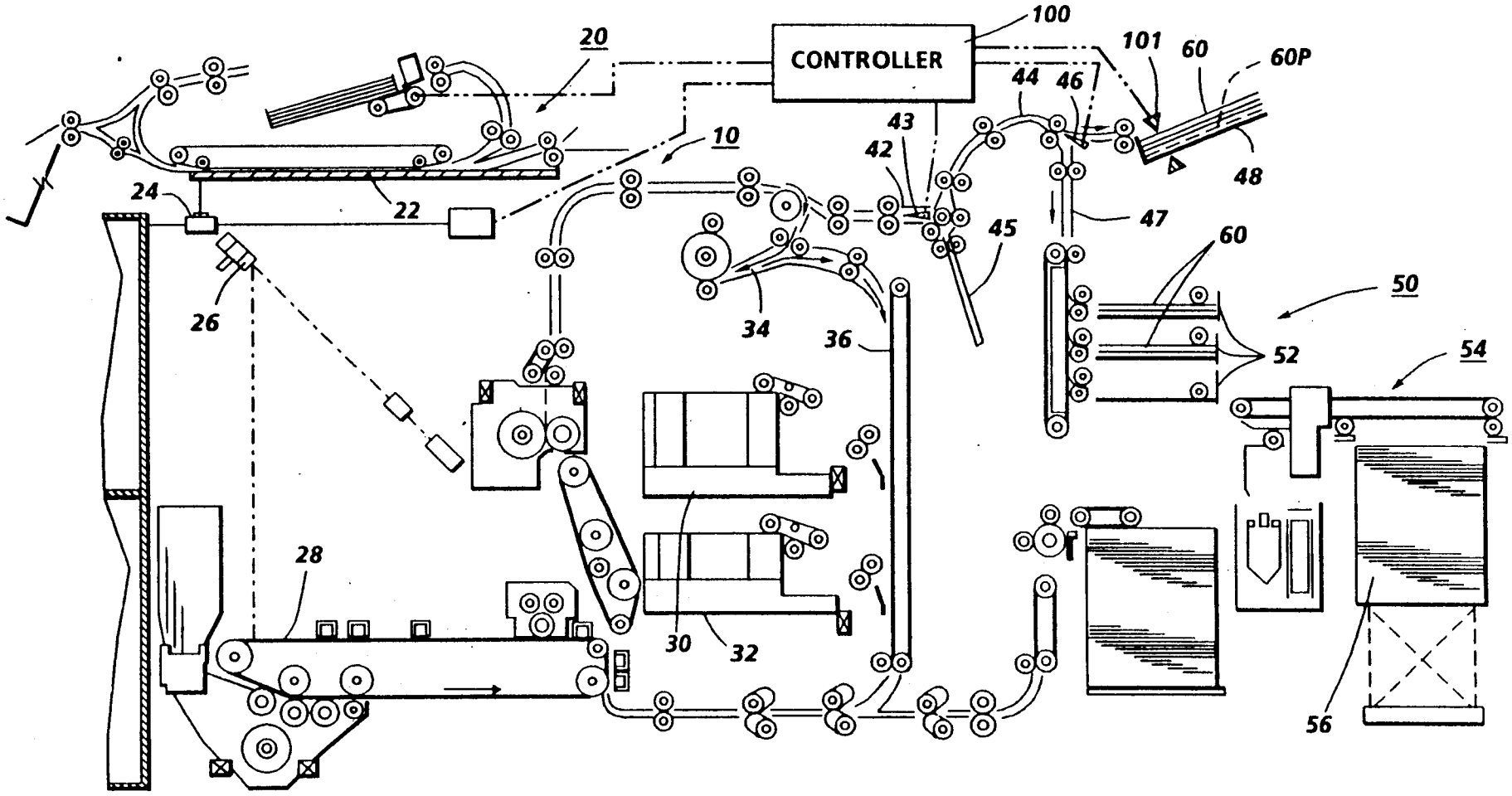

Cross-reference and incorporation by reference is made to a copending application by the same assignee, filed June 25, 1990, as U.S. application Ser. No. 07/543,031, by A. L. Bertoni, et al, entitled "Stream Printing". Also, to another copending application by the same assignee, filed July, 1990, by R. C. Ryon et al, entitled "Dual Mode Document Registration System", U.S. Ser. No. 07/546,984. Also, to two other contemporaniously filed applications by the same assignee, U.S. Ser. Nos. 07/589,613 and 07/590,672, by Michael E. Farrell, et al., entitled "Printer Optimized Dynamic Job Recovery", and by Carol P. Parsons, entitled, "Modulus", respectively. The present system may be used in combination with "job streaming" printing as described in the former and/or in the apparatus disclosed in both, but is not limited thereto.

Although there is disclosed in the particular example herein, and above, an electrostatographic printer, the present system may be used in various printers or copiers with two or more sheet outputs. It is particularly useful in precollation copying or printing systems where, as is well known, the output is in plural collated sets of copies or prints, and the collation or page order of each set should be maintained in spite of copier or printer jams, misfeeds, or other interruptions in normal printing.

There is disclosed hereinbelow, by way of one particular example of the invention, a simple system for reduced printing delays in copying or printing in spite of the need to "purge" certain of the sheets which were printed, i.e., to segregate and separately dispose of those sheets rather than include them in the completed or finished sets or package packages of final copies or prints. In this particular disclosed example, properly printed copy sheets {called copy sheets below} generated from the printing operation may be selectably operator directed to various different copy sheet output compiling stations, such as a stacking tray or a finisher complier. Those copy sheets desired to be purged rather than provided as finished copies {called purge or purged sheets below} are directed to a particular designated such copy sheet output compiling station, for operator removal and disposal of those purge sheets. Preferably this designated purge station is an existing but readily operator accessible output station, such as a top tray and/or sample copy tray. In this particular disclosed example, reduced printing delays are provided by continuing the printing process as long as the properly printed copy sheets are selectably directed to a copy sheet output compiling station which is not the same tray or station into which the purge sheets have been directed in the same the printing operation, or, as long as copy sheets will not be stacked on top of purge sheets in that same tray. The printing operation of the copy sheets is automatically stopped to prevent intermixing of the purged sheets with the properly printed copy sheets in the same copy sheet output compiling station. However, preferably this interrupted printing operation can then resume in response to sensing that all the sheets in that tray have been removed by the operator, which the operator is preferably directed to do.

Various types of copier or printed sheet purging systems and/or printing shutdown systems are known in the art. The following Xerox Corporation U.S. Pat. Nos. are noted as examples: 3,788,051 issued Dec. 11, 1973 to Allen et al (note Col. 3, middle); 3,936,180 issued Feb. 3, 1976 to Willard et al (note Col. 4 lines 53 to Col. 5 line 8); and 4,231,567 issued Nov. 4, 1980 to R. T. Ziehm. Also noted is Ricoh Company U.S. Pat. No. 4,750,020 issued June 7, 1988 to Ishizu et al.

As to specific hardware components of the subject apparatus, it will be appreciated that, as is normally the case, some such specific hardware components, or suitable alternatives, are known per se in various patents, apparatus or applications. Only a few can be cited here. Particularly noted re the disclosed exemplary copy paper path, trays, and on-line finishing station and its operation is Xerox Corporation U.S. Pat. No. 4,782,363 issued Nov. 1, 1988 to J. E. Britt, et al.

It should be noted that, as used herein, the terms "defective" or "purged" or "purge" sheet is broadly defined as including not only damaged or non-imaged sheets. This also includes properly printed sheets which need to be purged anyway for various reasons. For example, they may need to be purged because they are out of proper collation order, or part of incomplete job sets, as a result of document image delays or errors, or copy sheet misfeeds, or jams of prior or subsequent sheets, or running out of tabs or cover stock, or other printer or copier conditions for which separate-tray purging of such sheets may be desirable. i.e., to segregate and separately dispose of those sheets rather than include them in the completed or finished sets or package packages of final copies or prints. Likewise, the term "copy sheet output compiling station" is broadly defined as comprising any type of location of sheet stacking tray and/or finishers complier, unless indicated otherwise in context.

A specific feature of the specific embodiment disclosed herein is to provide in a method of copying or printing in which properly printed copy sheets generated from the printing operation may be selectably operator directed to various different copy sheet output compiling stations, and wherein copy sheets to be purged may be directed to a said copy sheet output compiling station which is being designated as a purged sheets output compiling station; the improvement wherein, as long as said properly printed copy sheets are selectably directed to a said copy sheet output compiling station which is not the said copy sheet output compiling station into which said purged sheets had been directed in the same printing operation, then said properly printed copy sheets will continue to be printed without stopping said printing operation, unless said properly printed copy sheets are selectably directed to said same purged sheets output compiling station after any of said purged sheets have been directed thereto, but not removed therefrom, in the same said printing operation, in which event said printing operation of said properly printed copy sheets will be stopped to prevent intermixing of said purged sheets with said properly printed copy sheets in the same said copy sheet output compiling station.

Further specific features provided by the exemplary system disclosed herein below, individually or in combination, include those wherein; said designated purged sheets output compiling station is a top tray, and a normal said copy sheet output compiling station is a finisher compiler; and/or in which said designated purged sheets output compiling station is an operator accessible stacking tray for sequentially stacking either said properly printed copy sheets or said purged sheets stacked therein, and/or wherein said purged sheets can be placed in said same tray with said properly printed copy sheets without interrupting said printing operation as long as said purged sheets will be stacked on top of said properly printed copy sheets in said same tray, but said printing operation is automatically interrupted if there is a said operator direction selection which could result in said properly printed copy sheets being stacked on top of said purged sheets in said same tray; and/or in which the presence or absence in said stacking tray of any said properly printed copy sheets or purged sheets is sensed, and said automatically interrupted printing operation may be resumed as soon as all said sheets are so sensed as having been removed from said stacking tray.

As xerographic and other copiers and printers increase in speed, and become more automatic, it is increasingly important to provide higher speed yet more reliable and more automatic handling of the sheets being copied, i.e. the output of the copier. It is desirable to reliably feed and accurately register for copying sheets of a variety or mixture of sizes, types, weights, materials, conditions and susceptibility to damage. Yet with this and other sheet stack feeding systems, it is very desirable to provide minimal interruptions from the inevitable double-sheet feeding (mis-separations), misfeeding, skewing, or other potential interruptions in copying. Particularly in high speed machines, purging some sheets occasionally to allow continued printing operations is preferable to stopping all printing until the condition is corrected, or "cycle out" as is typically done in small copiers. A system of purging with continued printing assumes, of course, that the problem is not one which completely blocks further printing.

The disclosed apparatus may be readily operated and controlled in a conventional manner with known or conventional copier or printer control systems, operated as taught herein. Some additional examples of various prior art copiers with document handlers and control systems therefor, including sheet detecting switches, sensors, etc., are disclosed in U.S. Pat. Nos.: 4,054,380; 4,062,061; 4,076,408; 4,078,787; 4,099,860; 4,125,325; 4,132,401; 4,144,550; 4,158,500; 4,176,945; 4,179,215; 4,229,101; 4,278,344; 4,284,270, and 4,475,156. It is well known in general and preferable to program and execute such control functions and logic with known software instructions for known microprocessors. This is taught by the above and other patents and various commercial copiers. Such software may of course vary depending on the particular function and the particular software system and the particular microprocessor or microcomputer system being utilized, but will be available to or readily programmable by those skilled in the applicable arts without undue experimentation from either verbal functional descriptions, such as those provided herein, or prior knowledge of those functions which are conventional, together with general knowledge in the software and computer arts. Controls may alternatively by provided utilizing various other known or suitable hardwired logic or switching systems. As shown in the above-cited art, the control of exemplary document and copy sheet handling systems in copiers or printers may be accomplished by conventionally actuating them by signals from the copier controller directly or indirectly in response to simple programmed commands and from selected actuation or non-actuation of conventional copier switch inputs by the copier operator, such as switches selecting the number of copiers to be made in that run, selecting simplex or duplex copying, selecting whether the documents are simplex or duplex, selecting a copy sheet supply tray, etc. The operator inputs and controls, and machine internal controls or limits, may be coordinated and/or made interactive with operator displays and "prompts" or instructions. E.g., U.S. Pat. No. 4,332,465 issued June 1, 1982 re the Xerox Corporation "5700" printer. The resultant controller signals may conventionally actuate various conventional electrical solenoid or cam-controlled sheet deflector fingers, motors or clutches in the copier in the selected steps or sequences as programmed. Conventional sheet path sensors, switches and bail bars, connected to the controller, may be utilized for sensing and timing the positions of documents and copy sheets, as is well known in the art, and taught in the above and other patents and products. Known copying systems utilize such conventional microprocessor control circuitry with such connecting switches and sensors for counting and comparing the numbers of documents and copy sheets as they are fed and circulated, keeping track of their general positions, counting the number of completed document set circulations and completed copies, etc. and thereby controlling the operation of the document and copy sheet feeders and inverters, etc..

All references cited in this specification, and their references, are incorporated by reference herein where appropriate for appropriate teachings of additional or alternative details, and/or technical background.

Various of the above-mentioned and further features and advantages will be apparent from the specific apparatus and its operation described in the example(s) below, as well as the claims. Thus the present invention will be better understood from this description of an embodiment thereof, including the drawing figure (approximately to scale) wherein:

The FIGURE, is a schematic side view of one embodiment of a printer apparatus incorporating one example of the subject system.

Describing now in further detail the exemplary embodiment with reference to the FIGURE, there is shown a duplex printer reproducing machine 10 by way of one example of an apparatus in which this particular disclosed method may be utilized.

The printer 10 and its original document presentation system 20 may be like that disclosed in the above cited Xerox Corporation U.S. Pat. No. 4,782,363 issued Nov. 1, 1988 to J. E. Britt, et al. An electronic document imaging system 24, and a laser scanning system 26 imaging a photoreceptor 28, may be provided as shown here and in the above cross-referenced applications. Alternatively this may be a conventional optical imaging system. As discussed above, operator inputs and controls and machine internal controls and operator displays and "prompts" or instructions are provided in a controller 100 with displays.

Here, in the printer 10, a generally conventional xerographic system example is shown, with clean paper trays 30 and 32 feeding unimaged copy sheets through a paper path to be imaged at the transfer area of engagement with the photoreceptor 28. Then the copy sheets are fused and outputted sequentially via path 42. Alternatively, for duplex (two-sided) copies, the copy sheets may be diverted to an inverter 34, and returned via path 36 for second side imaging before being outputted via path 42. In the output path 42 a selectable deflector gate 43 may be provided to invert the copy sheets via an inverter 45 if gate 43 is actuated. Then the copy sheets pass on via path 44 to an output station selection gate 46.

If the sheet deflector gate 46 is selected by the operator (via controller 100 inputs and software) to be up, as shown, all copy sheets after that are deflected into a finisher path 47 to the finisher 50 compiler trays 52, from which the completed copy sets are removed 54 and bound or stapled and output stacked 56. Alternatively, if the gate 46 is selected by the operator to be down, then all outputting copy sheets after that are deflected into a readily accessible top tray 48. The presence or absence of any sheets in that top tray 48 is sensed by a conventional optical or flag sensor 101 conventionally connecting with the controller 100.

Shown here in tray 48 and in one pair of finisher compiler trays 52 are properly printed and collated outputted copy sheets 60. Shown for illustration only, previously purged copy sheets 60P are shown underneath subsequently outputted properly printed copy sheets 60 in tray 48. This is the condition which is prevented by this system.

As noted, in this system properly printed copy sheets (copy sheets) generated from the printing operation may be selectably operator directed to various different copy sheet output compiling stations, such as the top stacking tray 48 or the finisher 50 complier 52. Meanwhile, those copy sheets desired to be purged rather than provided as finished copies (purge sheets 60P) may also be directed to a particular one such station for operator removal and disposal. Preferably this designated or selected purging station or purge tray in this example is the top tray 48. In this system, reduced printing delays are provided by continuing the copy sheet 60 printing operation as long as the properly printed copy sheets are selectably directed to any copy sheet output compiling station other than the selected purge tray 48. However, in some cases, as shown, the operator or the machine controller 100 may want to select the same tray or station 48 to stack properly printed copy sheets 60, i.e. to use the same tray 48 into which the purge sheets 60P have also been or will be directed during the same the printing operation. The present system additionally allows printing to continue in that case also, but only as long as the good copy sheets 60 will not be stacked on top of, rather than underneath, purge sheets in that same tray.

That is, the printing operation of the copy sheets is automatically stopped to prevent intermixing of the purged sheets stacking with the properly printed copy sheets in the same tray or compiling station, but can continue if their were and are no prior purges to that tray, (i.e., previously rather than subsequently purged sheets), so that no purged sheets will be hidden under subsequent good copy sheets directed to that same tray. But subsequent purges, particularly purge sheets from or at cycle-out, can be put into the tray 48 on top of prior good copy sheets. Or, to express it another way, this system prevents stacking good copy sheets on top of or otherwise intermixed with purge sheets, but allows printing to continue until that condition is attempted.

However, even this interrupted printing operation condition can be resumed in response to sensing that all the sheets in that tray 48 have been removed, by the tray 48 sheet presence/absence sensor 101, or the like. The operator display of the controller 100 is preferably directed or programmed to display a direction to clear the tray 48 in the event of such a printing interruption. Once that is done, and is confirmed by the tray sensor 101, the interrupted printing operation may resume, automatically or by the usual start print command.

While the embodiment disclosed herein is preferred, it will be appreciated from this teaching that various alternatives, modifications, variations or improvements therein may be made by those skilled in the art, which are intended to be encompassed by the following claims:

What is claimed is:

1. In a method of copying or printing in which properly printed copy sheets generated from the printing operation may be selectably operator directed to various different copy sheet output compiling stations, and wherein copy sheets to be purged may be directed to a said copy sheet output compiling station which is being designated as a purged sheets output compiling station;

the improvement wherein, as long as said properly printed copy sheets are selectably directed to a said copy sheet output compiling station which is not the said copy sheet output compiling station into which said purged sheets had been directed in the same said printing operation, then said properly printed copy sheets will continue to be printed without stopping said printing operation, unless said properly printed copy sheets are selectably directed to said purged sheets output compiling station after any of said purged sheets have been directed thereto, but not removed therefrom, in the same said printing operation, in which event said printing operation of said properly printed copy sheets will be stopped to prevent intermixing of said purged sheets with said properly printed copy sheets in the same said copy sheet output compiling station.

2. The method of copying or printing of claim 1, in which said designated purged sheets output compiling station is a top tray, and a normal said copy sheet output compiling station is a finisher compiler.

3. The method of copying or printing of claim 1, in which said designated purged sheets output compiling station is a operator accessible stacking tray for sequentially stacking either said properly printed copy sheets or said purged sheets stacked therein, and wherein said purged sheets can be placed in said same tray with said properly printed copy sheets without interrupting said printing operation as long as said purged sheets will be stacked on top of said properly printed copy sheets in said same tray, but said printing operation is automatically interrupted if there is a said operator direction selection which could result in said properly printed copy sheets being stacked on top of said purged sheets in said same tray.

4. The method of copying or printing of claim 2, in which said designated purged sheets output compiling station is a operator accessible stacking tray for sequentially stacking either said properly printed copy sheets or said purged sheet stacked therein, and wherein said purged sheets can be placed in said same tray with said properly printed copy sheets without interrupting said printing operation as long as said purged sheets will be stacked on top of said properly printed copy sheets in said same tray, but said printing operation is automatically interrupted if there is a said operator direction selection which could result in said properly printed copy sheets being stacked on top of said purged sheets in said same tray.

5. The method of copying or printing of claim 3, in which the presence or absence in said stacking tray of any said properly printed copy sheets or purged sheets is sensed, and said automatically interrupted printing operation may be resumed as soon as all said sheets are so sensed as having been removed from said stacking tray.

6. The method of copying or printing of claim 4, in which the presence or absence in said stacking tray of any said properly printed copy sheets or purged sheets is sensed, and said automatically interrupted printing operation may be resumed as soon as all said sheets are so sensed as having been removed from said stacking tray.

* * * * *